US010011985B2

(12) United States Patent
Strong

(10) Patent No.: US 10,011,985 B2
(45) Date of Patent: Jul. 3, 2018

(54) PORTABLE, MULTI-ROOMED SYSTEM AND METHOD

(71) Applicant: Linxx Global Solutions, Inc., Virginia Beach, VA (US)

(72) Inventor: Martin Leigh Strong, Virginia Beach, VA (US)

(73) Assignee: Linxx Global Solutions, Inc., Virginia Beach, VA (US)

( * ) Notice: Subject to any disclaimer, the term of this patent is extended or adjusted under 35 U.S.C. 154(b) by 0 days.

(21) Appl. No.: 15/367,641

(22) Filed: Dec. 2, 2016

(65) Prior Publication Data

US 2017/0159289 A1 Jun. 8, 2017

Related U.S. Application Data

(60) Provisional application No. 62/263,937, filed on Dec. 7, 2015.

(51) Int. Cl.

| | |
|---|---|
| ***E06B 9/08*** | (2006.01) |
| ***E04B 2/76*** | (2006.01) |
| ***E06B 9/17*** | (2006.01) |
| ***E04B 2/72*** | (2006.01) |
| *E06B 9/00* | (2006.01) |

(52) U.S. Cl.

CPC ..... *E04B 2/76* (2013.01); *E04B 2/72* (2013.01); *E06B 9/08* (2013.01); *E06B 9/17* (2013.01); *E06B 9/17007* (2013.01); *E06B 2009/002* (2013.01)

(58) Field of Classification Search

CPC . E04H 17/18; E04H 4/06; E04H 17/20; E04F 13/028; E04F 13/024; E04F 13/04; E04B 2/76; E04B 2/72; E06B 2009/002; E06B 9/08; E06B 9/17; E06B 9/17007; E06B 11/02

USPC ..... 160/24

See application file for complete search history.

(56) References Cited

U.S. PATENT DOCUMENTS

| | | | | |
|---|---|---|---|---|
| 1,631,227 A * | 6/1927 | See | ..... | E04H 12/2246 211/196 |
| 3,794,279 A * | 2/1974 | Kramer | ..... | E04H 12/2246 248/160 |
| 6,375,164 B1 * | 4/2002 | Siegler | ..... | E01F 13/028 256/1 |
| 6,575,435 B1 * | 6/2003 | Kotzen | ..... | E04H 4/06 160/10 |

(Continued)

FOREIGN PATENT DOCUMENTS

| | | |
|---|---|---|
| EP | 1559853 A1 | 8/2005 |
| EP | 1973090 B1 | 6/2012 |

OTHER PUBLICATIONS

PCT International Patent Application No. PCT/US2016/064636, International Search Report and Written Opinion dated Mar. 16, 2017, 14 pages.

*Primary Examiner* — Luz Adriana Figueroa

(74) *Attorney, Agent, or Firm* — Kilpatrick Townsend & Stockton LLP

(57) ABSTRACT

A wall system includes a plurality of wall assemblies. The wall assembly includes a post and a wall that is rotatably supported within the post to allow for controlled extension and retraction of the wall. An edge of the wall includes a key that is received within a keyhole of an adjacent post to secure the wall in an extended position between the adjacent posts.

19 Claims, 14 Drawing Sheets

(56) References Cited

U.S. PATENT DOCUMENTS 6,619,610 B1 * 9/2003 Genovese ..... E04H 12/2246 135/118
6,733,204 B1 * 5/2004 Paniccia ..... E01F 7/06 160/238
6,776,398 B1 * 8/2004 Tsai ..... E01F 13/028 256/37
7,217,061 B2 * 5/2007 Stratton ..... E01F 7/00 160/24
7,219,709 B1 * 5/2007 Williams ..... E01F 13/028 160/24
7,350,480 B1 * 4/2008 Hughes ..... A01K 3/005 119/512
7,377,490 B1 * 5/2008 Khosravian ..... E01F 13/028 119/416
7,971,622 B2 * 7/2011 Trionfetti ..... E04B 2/7416 160/122
D656,623 S * 3/2012 Emrey ..... D25/48.4
8,261,806 B2 * 9/2012 Wettern ..... E01F 13/028 160/24
8,434,732 B1 * 5/2013 Penn ..... B60P 3/04 119/512
8,991,470 B1 * 3/2015 Pacheco ..... G08B 3/00 160/240
9,714,491 B2 * 7/2017 Wettern ..... E01F 13/022
2002/0063248 A1 * 5/2002 Siegler ..... E01F 13/028 256/37
2003/0164485 A1 * 9/2003 Olson ..... B21F 33/002 256/37
2004/0262589 A1 * 12/2004 Cotton ..... E04H 12/2215 256/25
2005/0193651 A1 * 9/2005 Kirk ..... E06B 9/04 52/202
2006/0151123 A1 * 7/2006 Chandler ..... E01F 13/028 160/24
2010/0181544 A1 7/2010 Wettern
2011/0017965 A1 1/2011 Kowalewicz
2013/0221301 A1 8/2013 Cowie et al.
2014/0190097 A1 * 7/2014 Drifka ..... E06B 9/581 52/204.1
2014/0299829 A1 * 10/2014 Herman ..... B23K 31/02 256/46

* cited by examiner

PORTABLE, MULTI-ROOMED SYSTEM AND METHOD

REFERENCE TO RELATED APPLICATION

This application claims the benefit of U.S. Provisional Application No. 62/263,937, filed Dec. 7, 2015, the contents of which are hereby incorporated by reference in its entirety.

BACKGROUND

Field

This application relates a multi-roomed system and method, and more particularly to a portable, lightweight, rugged multi-roomed structure that allows for easy storage, transport, rapid set up, use, and breakdown.

Background Technology

Tactical training in urban environments requires single or multi-room dwellings or structures that are fully constructed structures combined to create a town, military target, or other simulated environment. These training centers are typically permanent or semi-permanent structures that are expensive to build and maintain and that are chronically booked well in advance. The use of live bullets (rounds) for training also requires very strictly controlled construction of expensive "shooting houses," although training with special training weapons that shoot plastic pellets has reduced the demand and requirement for ballistically safe "shooting houses."

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various examples, a wall system includes a first wall assembly and a second wall assembly. The first wall assembly includes a first post and a first wall. The first post includes a top end, a bottom end, an outer surface, and an inner surface. The inner surface defines a first chamber that extends between the top end and the bottom end. The first post also defines a first deployment slot extending between the top end and the bottom end and providing access to the first chamber. The first wall includes a first edge and a second edge that includes at least one key. The first wall is rotatably housed within the first chamber and is horizontally deployable through the first deployment slot. The second wall assembly includes a second post that includes a top end, a bottom end, an outer surface, and at least one keyhole along at least a portion of the outer surface of the second post. The at least one keyhole is dimensioned to accommodate one of the at least one keys and secure the one key within the at least one keyhole.

In some examples, the second post further includes an inner surface that defines a second chamber extending between the top end and the bottom end. In these examples, the second post defines a second deployment slot extending between the top end and the bottom end and providing access to the second chamber. In various cases, the second wall assembly further includes a second wall having a first edge and a second edge, and the second wall is rotatably housed within the second chamber and is horizontally extendable through the second deployment slot. In various examples, the system at least one keyhole bracket supports the at least one keyhole. In some cases, the second deployment slot includes a first edge and a second edge and the at least one keyhole bracket includes a first edge and a second edge. In certain examples, the at least one keyhole bracket extends along the outer surface of the second post such that the first edge of the at least one keyhole bracket is proximate to the first edge of the second deployment slot and the second edge of the at least one keyhole bracket is proximate to the second edge of the second deployment slot.

In some cases, a stabilizer extending from the first post to the second post. In various examples, the first post further includes a first mounting pin extending radially outward from the outer surface of the first post proximate to the top end of the first post and the second post further includes a second mounting pin extending radially outward from the outer surface of the second post proximate to the top end of the second post. In some examples, the stabilizer includes a first end and a second end distal from the first end, and the stabilizer defines a first mounting bore proximate to the first end and dimensioned to accommodate the first mounting pin. In certain examples, the stabilizer defines a second mounting bore proximate to the second end and dimensioned to accommodate the second mounting pin.

In various examples, the stabilizer includes a first end and a second end distal from the first end, and the stabilizer further includes a first body portion and a second body portion. The first body portion includes the first end and the second body portion includes the second end. In these examples, the first body portion is adjustable relative to the second body portion such that a distance between the first end and the second end is adjustable between a first distance and a second distance. In some examples, a first base vertically supports the first post and a second base vertically supports the second post. In certain cases, the first base and the second base each include hollow bodies configured to hold a fillable material within the respective hollow bodies. In certain examples, the first base and the second base each further includes a retainer ring and at least one foot. The at least one foot includes a body and a foot key, and the retainer ring defines at least one foot slot dimensioned to accommodate the foot key of the at least one foot.

In certain cases, the first wall is horizontally deployable through the first deployment slot between a fully retracted configuration and a fully extended configuration. In the fully retracted configuration, a majority of the first wall is housed within the first chamber and the at least one key is engaged with the first deployment slot. In the fully extended configuration, the majority of the first wall is exterior to the first chamber and the at least one key of the wall is received within the at least one keyhole of the second post.

In some examples, the second edge of the first wall further includes a reinforcing member. In various cases, the second post includes a plurality of keyhole brackets along the outer surface of the second post between the top end and the bottom end of the second post, and each one of the plurality of keyhole brackets includes a plurality of keyholes. In various examples, the first wall includes a window.

According to various examples, a method of assembling a wall system includes: mounting and vertically supporting a first post on a first base; mounting and vertically supporting a second post on a second base; and horizontally deploying a first wall through a first deployment slot defined in the first post. The first wall is rotatably housed within a chamber defined by the first post, and the first deployment slot extends between a top end of the first post and a bottom end of the first post. The method also includes detachably engaging at least one key on an edge of the first wall with at least one keyhole provided on an outer surface of the second post.

In some examples, the method further includes mounting a stabilizer between the first post and the second post. In some cases, mounting the stabilizer includes mounting a first end of the stabilizer on a first mounting pin on the first post and mounting a second end of the stabilizer on a second mounting pin on the second post. In various examples, the method includes moving a first body portion of the stabilizer relative to a second body portion of the stabilizer to move the first end of the stabilizer from a first distance to a second distance relative to the second end of the stabilizer.

In various cases, the method includes disengaging the at least one key from the at least one keyhole and retracting the first wall through the first deployment slot into the chamber. In some examples, retracting the first wall further includes engaging the at least one key with the first deployment slot exterior to the chamber. In various embodiments, the method further includes removably attaching a foot to a retainer ring of the first base.

In some examples, the method further includes mounting and vertically supporting a third post on a third base and horizontally deploying a second wall through a second deployment slot defined in the second post. In certain examples, the second wall is rotatably housed within a chamber defined by the second post, and the second deployment slot extends between a top end of the second post and a bottom end of the second post. In certain cases, the method also includes detachably engaging at least one key on an edge of the second wall with at least one keyhole provided on an outer surface of the third post. In various examples, horizontally deploying the second wall includes extending the second wall at a non-zero angle relative to the first wall.

Various implementations described in the present disclosure can include additional systems, methods, features, and advantages, which cannot necessarily be expressly disclosed herein but will be apparent to one of ordinary skill in the art upon examination of the following detailed description and accompanying drawings. All such systems, methods, features, and advantages are included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
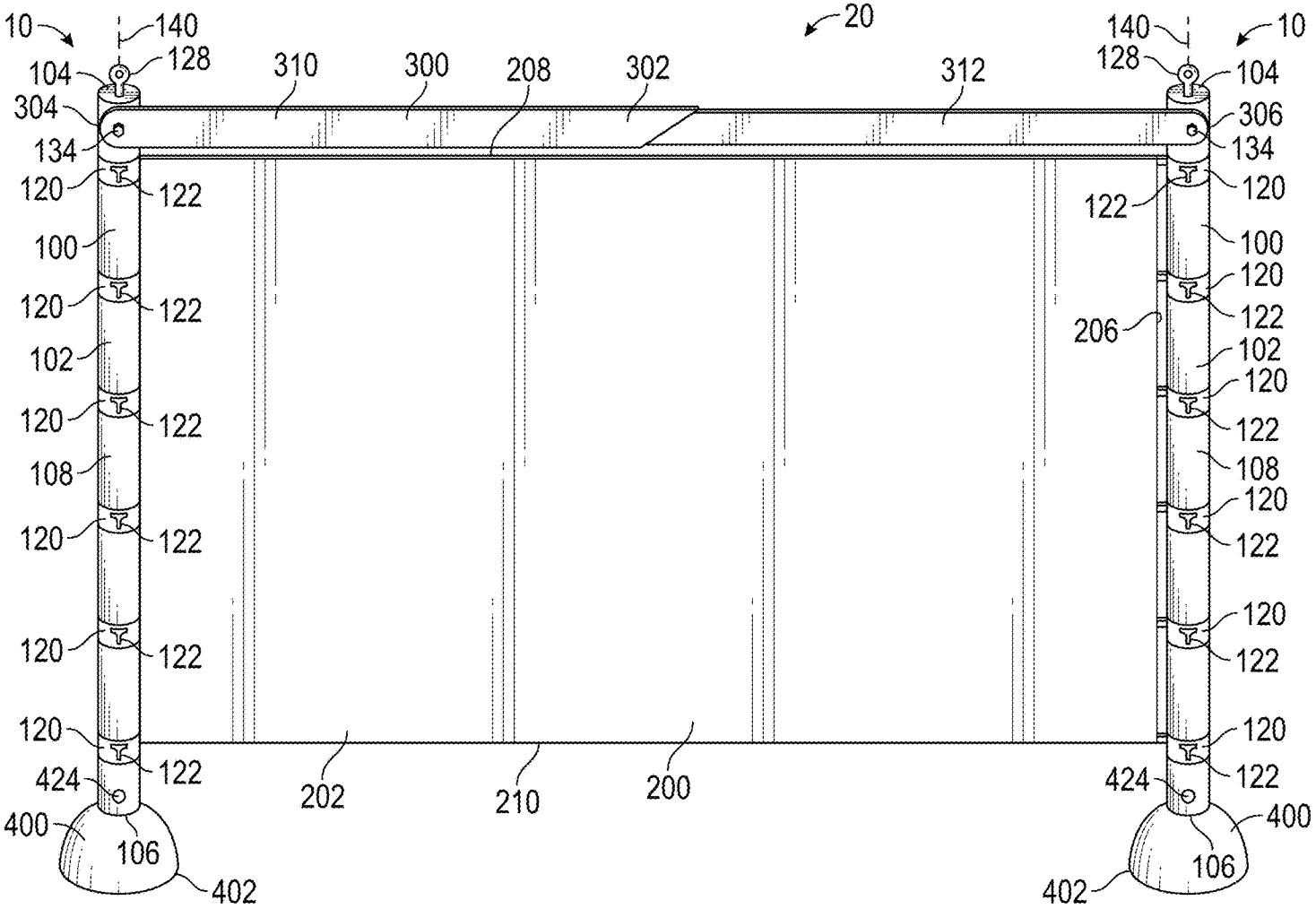
FIG. 1 is a perspective view of the wall assembly according to an example of the present disclosure, the wall assembly including two posts, a wall, and a stabilizer.

The subject matter of embodiments of the invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "forward," "aft," "up," "down," "top," "left," "right," "front," "back," and "corners," among others, are intended to refer to the orientation as illustrated and described in the figure (or figures) to which the components and directions are referencing.

Disclosed is a portable, lightweight, rugged multi-roomed structure that allows for easy storage, transport, rapid set up, use, and breakdown. Also disclosed are methods of constructing and deconstructing the disclosed system. The disclosed multi-roomed structure can be used in any suitable application, including but not limited to, professional tactics instructors in local/state/federal law enforcement, the military, and the like. The disclosed system, when deployed, creates a single or multi-roomed urban training environment that safely allows for the use of both plastic pellets and paint ball training weapons and that provides maximum flexibility as to location and configuration to mimic the desired training environment. The disclosed system is not limited to use in training environments, but may be used in any application where a single or multi-roomed structure is desired. The disclosed system can be deployed on any relatively flat surface outside or inside a facility such as, but not limited to, on relatively flat terrain or inside a warehouse or aircraft hangar.

FIGS. 1-5 illustrate an example of a wall system 20 including wall assemblies 10. In various examples, each wall assembly 10 includes a post 100, a base 400, and a wall 200. As described in detail below, a wall 200 is rotatably supported within each post to allow for controlled extension and retraction of the wall 200 during set-up and take-down of the wall system 20. For example, during set-up of the wall system 20, the wall 200 from a first of the posts 100 is extended from that first post and removably secured to a second post 100 such that the wall 200 extends between the two posts 100. During take-down, the wall 200 is disengaged from the second post 100 and retracted within the first post 100. In some examples, one or more stabilizers 300 may also be mounted on the two posts 100 such that the stabilizer 300 extends between adjacent posts to support the wall assemblies 10. In some cases, each wall assembly 10 may also include a skirt 500 (see FIG. 17), and/or the wall system 20 may include a case 700 (see FIG. 25) and/or an anchor 800 (see FIG. 16).

Figure 2:
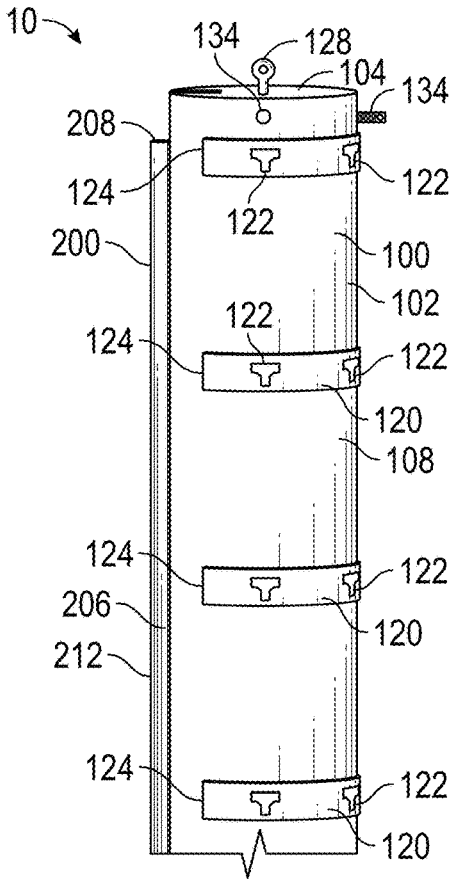
FIG. 2 is a side view of a portion of the wall assembly of FIG. 1.
Figure 3:
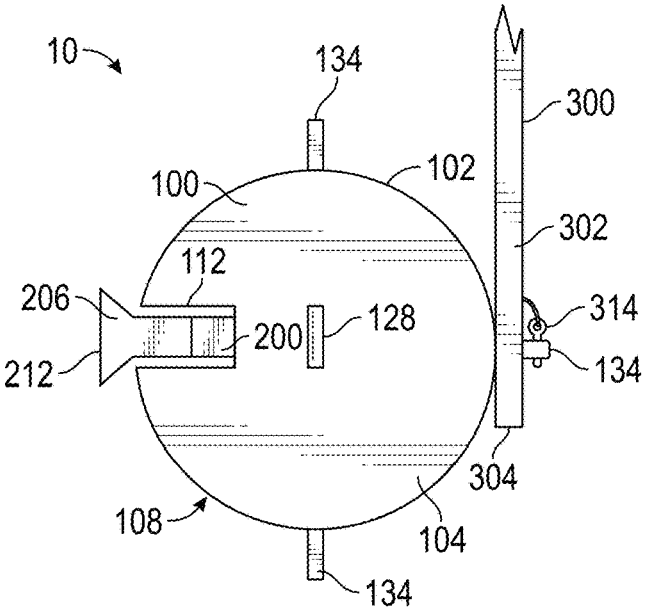
FIG. 3 is a top view of the wall assembly of FIG. 1.
Figure 4:
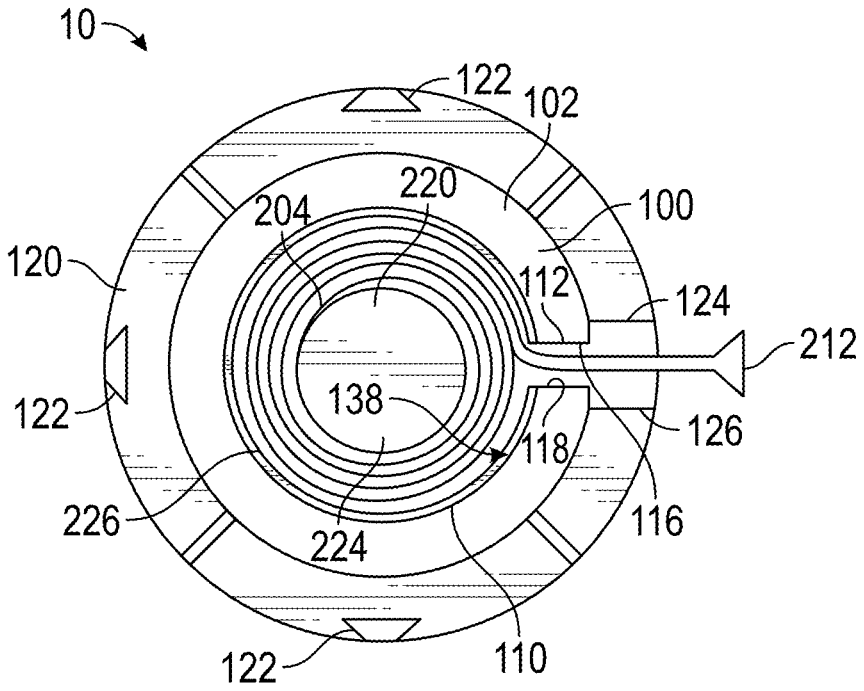
FIG. 4 is a top sectional view of the wall assembly of FIG. 1.

As illustrated in FIGS. 1-7, the post 100 includes a body 102 having a top end 104, a bottom end 106 distal from the top end 104, and an outer surface 108. A vertical axis 140 of the post 100 extends from the top end 104 to the bottom end 106. An inner surface 138 of the post 100 (FIG. 4) defines a chamber 110 that is dimensioned to rotatably house and support the wall 200, as described in detail below. In some cases, as shown in FIG. 4, the outer surface 108 of the body 102 defines a deployment slot 112 that provides access to the chamber 110. The deployment slot 112 includes a first edge 116 and a second edge 118. In various examples, the deployment slot 112 extends substantially parallel to the vertical axis 140 along at least a portion of the body 102. For example, in some cases, the deployment slot 112 may extend along the body 102 from proximate the top end 104 to proximate the bottom end 106, although it need not. In some cases, the cross-sectional profile shape of the deployment slot 112 is configured to prevent retraction of a key 212 of the wall 200 through the deployment slot 112 and into the chamber 110, as explained below.

As illustrated in FIGS. 1-2, and 5-7, in some cases, the post 100 includes a keyhole bracket 120 on the outer surface 108 of the body 102. In some cases, the keyhole bracket 120 is mounted on the body 102 using screws, bolts, pins, or various other suitable mounting mechanisms; in other cases, the keyhole bracket 120 may be integrally formed with the body 102. Any suitable number of keyhole brackets 120 may be provided on the body 102, and in various cases, the number of keyhole brackets 120 may correspond with the number of keys 212 of the wall 200. The keyhole bracket 120 defines at least one keyhole 122, and in various cases, the keyhole bracket 120 defines a plurality of keyholes 122. The keyholes 122 may be provided at regular or irregular intervals along the keyhole bracket 120. The keyholes 122 are configured to receive the keys 212 of the wall 200, as described in detail below. As shown in FIGS. 2 and 4, the keyhole bracket 120 may include a first edge 124 and a second edge 126 distal from the first edge 124. In some cases, the keyhole bracket 120 is provided on the body 102 such that the first edge 124 is proximate to the first edge 116 of the deployment slot 112 and the second edge 126 is proximate to the second edge 118 of the deployment slot 112, as illustrated in FIG. 4. In these examples, the keyhole bracket 120 extends at least partially around a perimeter of the body 102.

Figure 6:
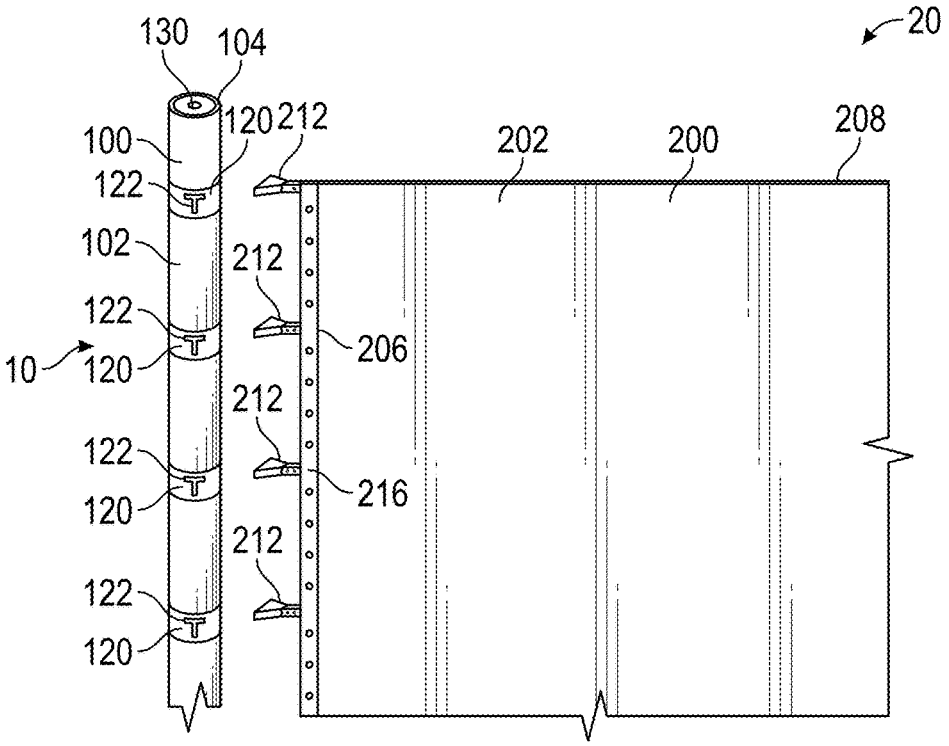
FIG. 6 is a side view of a portion of the wall assembly of FIG. 1.

In some cases, the top end 104 of the body 102 defines a mounting bore 130, as shown in FIG. 6. In some cases, a guide 128 (see FIG. 1) may optionally be secured to the body 102 through the mounting bore 130. In these examples, the guide 128 may be dimensioned to accommodate a securing wire or cord 132 that may be optionally used to provide stability to the wall assembly 10 (see FIG. 20). As described in detail below, in other cases, the stabilizer 300 may optionally be coupled to the body 102 through the mounting bore 130 to provide stability to the wall assembly 10 (see, e.g., FIGS. 9-10).

In various examples, as shown in FIGS. 1-3, the body 102 includes a mounting pin 134 or a plurality of mounting pins 134 provided at various locations on the outer surface 108 of the body 102. In some cases, the mounting pins 134 extend in a direction that is transverse to the vertical axis 140 of the post 100, although they need not. When a plurality of mounting pins 134 are utilized, the mounting pins 134 may be provided at regular or irregular intervals around the perimeter of the body 102, as illustrated in FIG. 3. As illustrated in FIGS. 2 and 3, in various examples, the mounting pins 134 are provided on the outer surface 108 proximate to the top end 104, although they need not be. The mounting pins 134 may be mounted to the body 102, although in various other examples, the mounting pins 134 may be integrally formed with the body 102. As described in detail below, the mounting pins 134 are configured to support the stabilizer 300 in various examples.

The post 100 may be constructed from various lightweight and durable materials, including but not limited to, various metals (such as but not limited to aluminum), composites, impact plastics, and various other suitable materials. The posts 100 have any suitable height (or distance from the top end 104 to the bottom end 106). In one non-limiting example, the post 100 may have a height of from about 6 feet to about 7 feet, although various other heights may be used as desired.

As shown in FIGS. 1-2, 4-7, and 14, the wall 200 includes a body 202 having a first edge 204, a second edge 206, a top edge 208, and a bottom edge 210. When coupled with the posts 100, the wall 200 extends between two posts 100 and is supported by the posts 100, as illustrated in FIG. 1. In particular, the wall 200 extends through the deployment slot 112 of a first post 100 such that the first edge 204 is positioned within the chamber 110 and the second edge 206 is exterior to the chamber 110 and is adjacent a second post 100 (see, e.g. FIG. 1 and FIG. 6). In various cases, the first edge 204 is rotatably supported within the chamber 110. In some cases, the first edge 204 may be rotatably supported within the chamber 110 through a spring 220, a spindle rotatably mounted within the chamber 110, or some other suitable similar mechanism such that the wall 200 is rotatably supported within the chamber 110. In the illustrated example, spring 220 includes a spring core 224 and a spring sheath 226.

Figure 7:
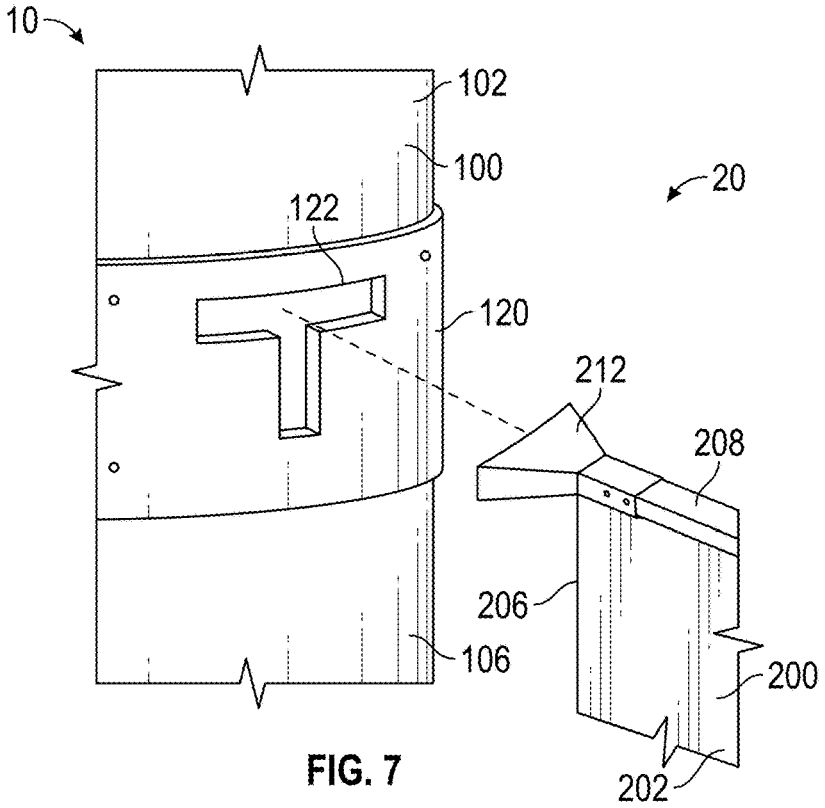
FIG. 7 is another detail view of a portion of the wall assembly of FIG. 1.

As shown in FIGS. 3-7, the second edge 206 of the wall 200 includes at least one key 212, and in various cases includes a plurality of keys 212. The at least one key 212 has a cross-sectional profile shape that is configured such that the second end 206 of the wall is restricted from being retracted through the deployment slot 112 and into the chamber 110. The cross-sectional profile shape of the key 212 is also complimentary to the shape of the keyhole 122 of the keyhole bracket 120 of the post 100. Specifically, the key 212 of the second end 206 of the wall 200 is shaped and dimensioned to be received within the key 212 of the post 100 and secured in place. In some examples, as shown in FIG. 7, the key 212 has a cross-sectional profile that is T-shaped. In other examples, various other shapes may be used to receive and lock the second end 206 of the wall 200 in position with respect to the post 100. In some cases, as illustrated in FIG. 6, the second edge 206 may also include a reinforcing member 216, although it need not. As illustrated, reinforcing member 216 is a band/strip of material that reinforces the wall 200.

In use, the wall 200 is extendable and retractable through the deployment slot 112. The spring, spindle 200, or other rotatable supporting mechanism within the chamber 110 allows for a controlled extension and retraction of the wall 200 during set-up and take-down of the wall assembly 10. In a fully retracted configuration (see FIGS. 2-4), the first end 204 of the wall 200 is secured within the chamber 110, a majority of the body 202 of the wall 200 is within the chamber 110, and the key 212 at the second edge 206 of the body 202 of the wall 200 is engaged with the deployment slot 112. In this configuration, the second edge 206 is not pulled within the chamber 110. In various examples, the wall assembly 10 includes the wall 200 in the retracted configuration relative to the post 100 before set-up of the wall system 20 or after take-down of the wall system 20.

Figure 5:
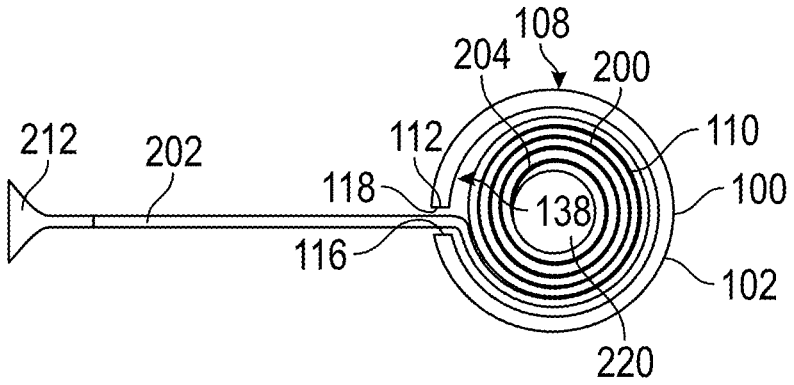
FIG. 5 is a top view of the post and the wall of the wall assembly of FIG. 1, shown with the wall in a partially extended configuration.

Between the fully retracted configuration and a fully extended configuration (see FIG. 1), the wall 200 is extendable to an intermediate configuration, as illustrated in FIG. 5. As illustrated in FIG. 5, in the intermediate configuration, a portion of the body 202 of the wall 200 is within the chamber 110 and a portion of the body 202 of the wall 200 is exterior to the chamber 110. The wall 200 may be coupled to an adjacent post 100 in the intermediate configuration in various cases where wall systems with walls 200 of different lengths are used.

In a fully extended configuration (see FIG. 1), a majority of the wall 200 is exterior to the chamber 110. In some cases, a combination of walls 200 in fully extended configurations and intermediate configurations may be used to create wall systems with various different layouts (see, e.g., FIGS. 20-23). In some cases, in the fully extended configuration, the key 212 of the second end 206 of the wall 200 is received within the keyhole 122 of a keyhole bracket 120 of an adjacent post 100 such that the wall 200 extends between adjacent posts 100. The wall 200 may be extended in the direction indicated by arrow 222 in FIG. 19 to various positions between the fully retracted and the fully extended configurations as desired, and the key 212 of the wall 200 may engage keyholes 122 of adjacent posts 100 at positions other than in the fully extended configuration.

In various examples, the wall 200 may comprise a durable, lightweight fabric. In some examples, the wall 200 may be flame retardant and impact-resistant. As one non-limiting example, the wall 200 may comprise the material sold under the trade name of Kevlar™ by E. I. DuPont de Nemours and Co., Wilmington, Del. In other cases, various other similar durable and lightweight fabrics may be used to form the wall 200.

Figure 14:
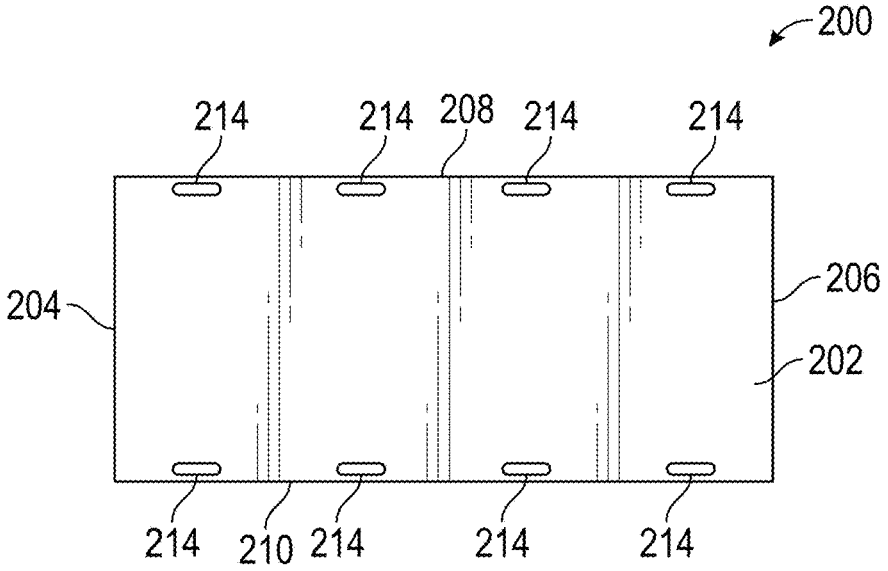
FIG. 14 is a front view of a wall of a wall assembly according to an example of the present disclosure.
Figure 19:
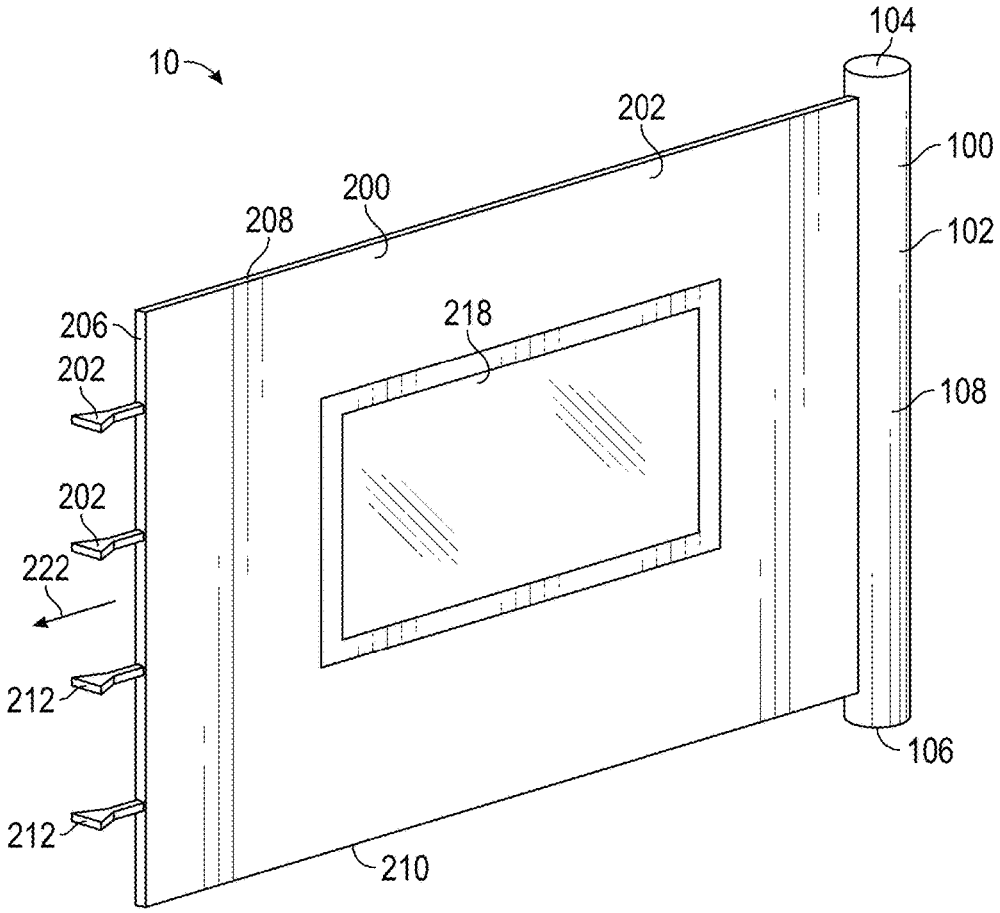
FIG. 19 is a perspective view of a wall assembly with a window according to an example of the present disclosure.

In various cases, as illustrated in FIG. 14, the wall 200 may also define an attachment slot 214 or slots 214 proximate to the top edge 208, proximate to the bottom edge 210, or proximate to both the top edge 208 and the bottom edge 210. In various cases, the attachment slots 210 may be configured to provide locations where various accessories or stabilizing mechanisms may be attached to the wall 200, as described in detail below. In some cases, as illustrated in FIG. 19, the wall 200 may include one or more windows 218. The windows 218 may comprise a flexible, durable material that is clear, semi-clear, or opaque as desired. In some cases, the windows 218 are constructed from a material that provides resistance to pellets, paintballs, and other non-lethal projectiles that may be used during training exercises.

Figure 8:
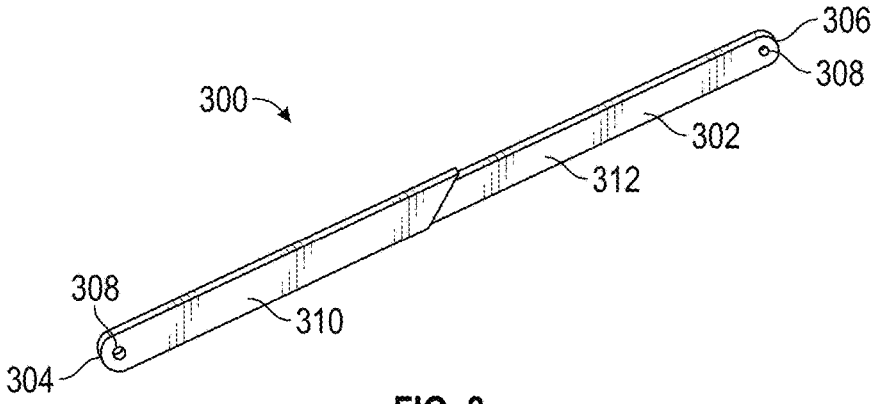
FIG. 8 is a perspective view of the stabilizer of the wall assembly of FIG. 1.

Referring to FIG. 8, in some cases, the stabilizer 300 includes a body 302 having a first end 304 and a second end 306. When assembled, the stabilizer 300 is configured to extend between adjacent posts 100 to provide stability to the wall assembly 10 in the horizontal direction. In some cases, the stabilizer 300 may be used to help distribute the weight of the wall 200 across the entire assembly 10 when the wall 200 is extended.

In various examples, the stabilizer 300 is adjustable such that a distance between the first end 304 and the second end 306 may be varied. In these cases, the body 302 may comprise a first portion 310 and a second portion 312 that is adjustable relative to the first portion 310. In some cases, the first portion 310 telescopes relative to the second portion 312.

In some examples, as shown in FIG. 8, the stabilizer 300 defines mounting bores 308 proximate to the first end 304 and the second end 306, respectively. In these examples, the mounting bores 308 are dimensioned to accommodate the mounting pins 134 of the post 100 such that the post 100 supports the stabilizer 300 through the mounting pins 134 engaged with the mounting bores 308. In some examples, as illustrated in FIG. 3, the stabilizer 300 may optionally include a locking pin 314 that is configured to engage the mounting pins 134 of the post 100 and retain the stabilizer 300 on a mounting pin 134 between the locking pin 314 and the body 102.

Figure 9:
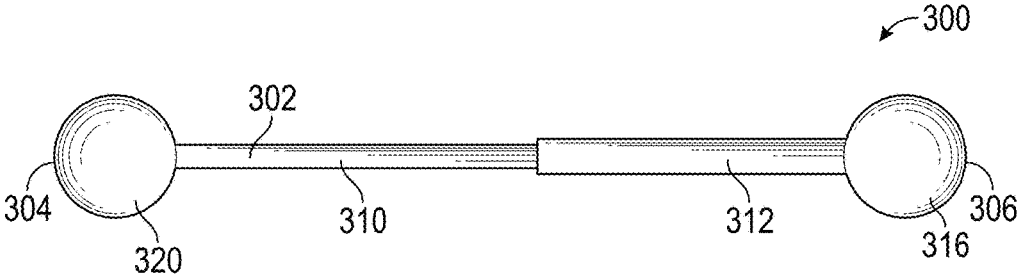
FIG. 9 is a top view of a stabilizer for a wall assembly according to an example of the present disclosure.
Figure 10:
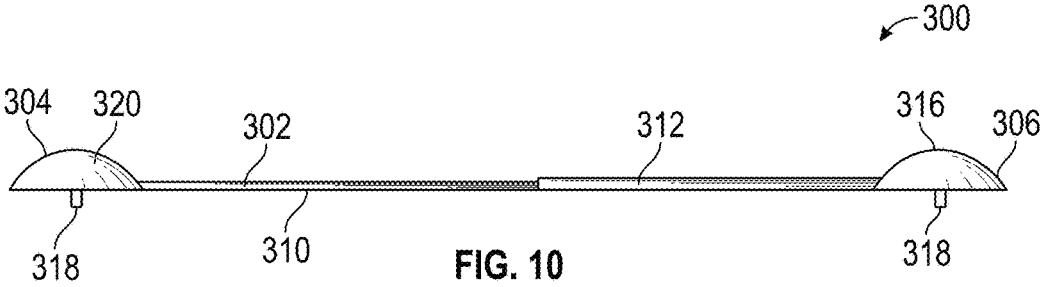
FIG. 10 is a side view of the stabilizer of FIG. 9.

In another example, as illustrated in FIGS. 9 and 10, the stabilizer 300 may include a first top cover 314 at the first end 304 and a second top cover 316 at the second end 306. In these examples, the top covers 314, 316 may each include attachment pins 318 that are configured to engage the mounting bores 130 on the top ends 104 of the posts 100. In other examples, the attachment pins 318 may be configured to engage bores defined on the outer surface 208 of the body 102 of the post 100. Instead of or in addition to mounting bores 308, mounting pins 134, and attachment pins 318, various other suitable mounting mechanisms, including but not limited to bolts, screws, pins, belts, hooks, clips, clasps, or various other suitable mechanisms, may be utilized.

Figure 11:
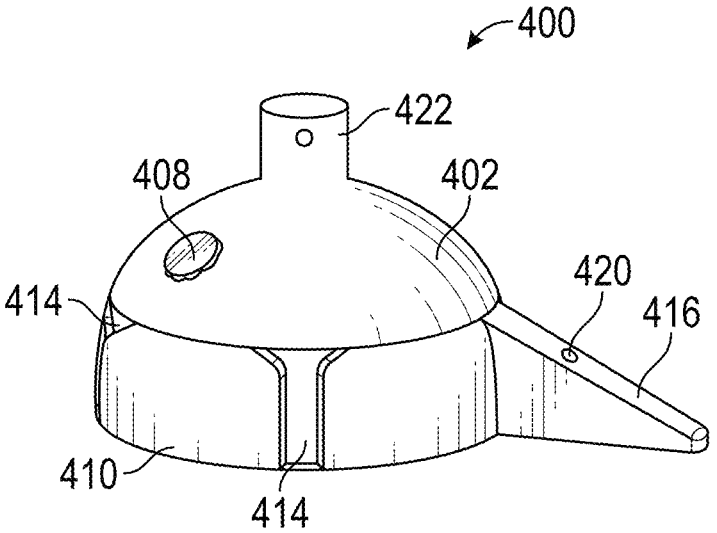
FIG. 11 is a perspective view of the base of the wall assembly of FIG. 1.
Figure 12:
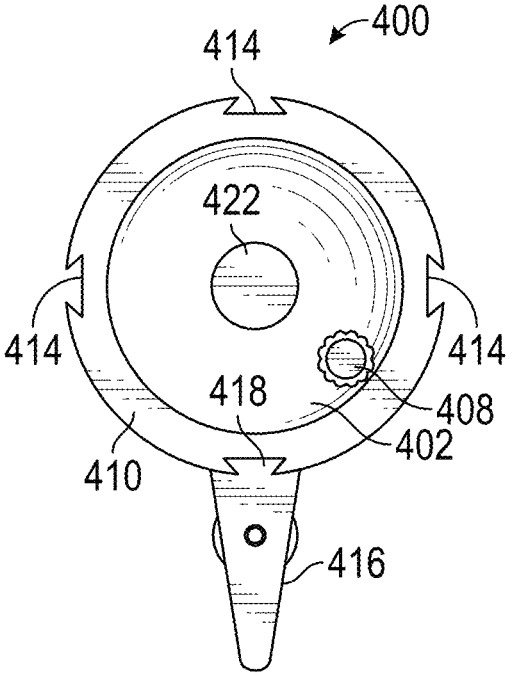
FIG. 12 is a top view of the base of FIG. 1.
Figure 13:
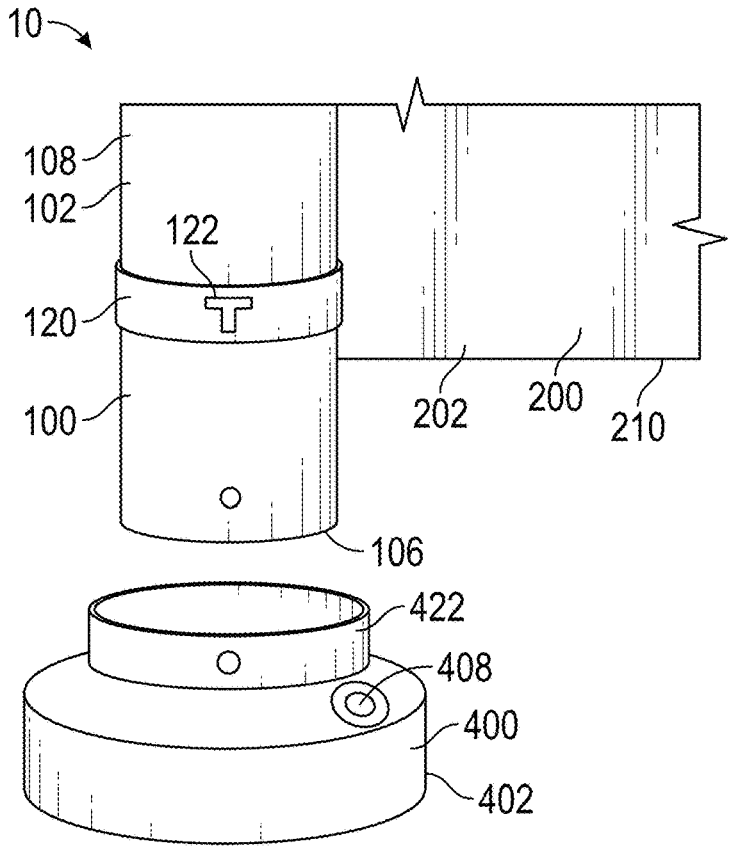
FIG. 13 is a perspective view of a portion of a wall assembly according to an example of the present disclosure.

The base 400 of FIG. 1 is illustrated in isolation in FIGS. 11-12. FIG. 13 illustrates another example of the base 400 having a shape that is different from the shape of the base 400 illustrated in FIGS. 1 and 11-12. The base 400 includes a body 402 having a mounting portion 422 that is configured to engage the post 100 such that the base 400 supports the post 100. In some cases, the mounting portion 422 may include pins 424, screws, bolts, hooks, clips, clasps, or various other suitable mechanisms for securing the post 100 relative to the base 400. In some cases, the mounting portion 422 may be configured to receive a portion of the post 100 within the mounting portion (FIG. 13), while in other examples, the mounting portion may be configured to be inserted into a portion of the post 100 (FIGS. 11 and 12).

In some examples, the base 400 is hollow and defines a chamber that is configured to accommodate a filling material, such as sand, water, dirt, etc., to weight the base 400. In these examples, the base 400 may include a fill port with a corresponding cap 408 that is removably attached to the base 400 to provide access to the fill port. In various cases, the weighted base 400 may help provide vertical stability for the post 100. In some cases, the base 400 may be filled with the filling material during use and may be emptied of the filling material during storage or transport to reduce storage space and weight when not in use.

In various examples, the base 400 includes a receiver ring 410. In some cases, the receiver ring 410 is a separate component from the base 400 that is removably attached to the base 400 when used. In other examples, the receiver ring 410 and the base 400 may be integrally formed as a unitary component. The receiver ring 410 defines a foot slot 414 or foot slots 416 that have a cross-sectional shape that is complimentary to a cross-sectional shape of a key 418 of a foot 416 (see FIGS. 11-12). In various cases, any number of feet 416 may be used with the base 400 to increase a footprint of the base 400 to provide additional stability. In some cases, feet 416 may be inserted into one, some, or all of the foot slots 414 of the retainer ring 410. In various cases, the feet 416 may also define receiving bores 420, which are dimensioned to accommodate stakes that may be inserted through the feet 416 and into a surface to provide additional support for the assembly 10. The shape of the feet 416 may vary as desired.

Figure 15:
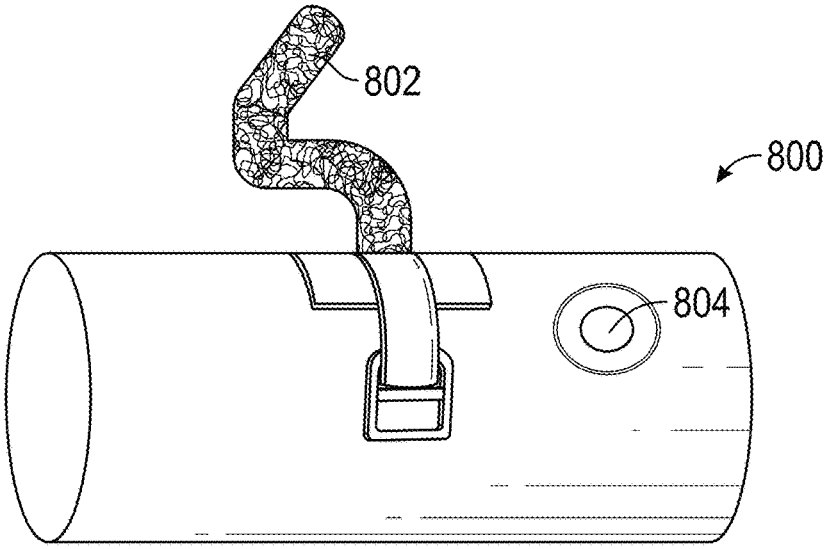
FIG. 15 is a perspective view of an anchor according to an example of the present invention.

As illustrated in FIG. 15, in some cases, an anchor 800 or anchors 800 may be provided with the wall assembly 10. In various examples, the anchor 800 includes a mounting portion 802 for removably attaching the anchor 800 to the wall 200 and/or to a post 100. In some cases, the anchor 800 may be fillable similar to the base 400, although it need not be. In cases where the anchor 800 is hollow and fillable similar to the base 400, the anchor 800 may include an anchor cap 804, which is removably attached to provide access to a chamber of the anchor 800. The anchor 800 is configured to provide vertical stability to the assembly 10 when attached. In some cases, anchors 800 are attached to the walls 200 through the attachment slots 214, although they need not, as various other suitable mounting attachment mechanisms may be used.

Figure 16:
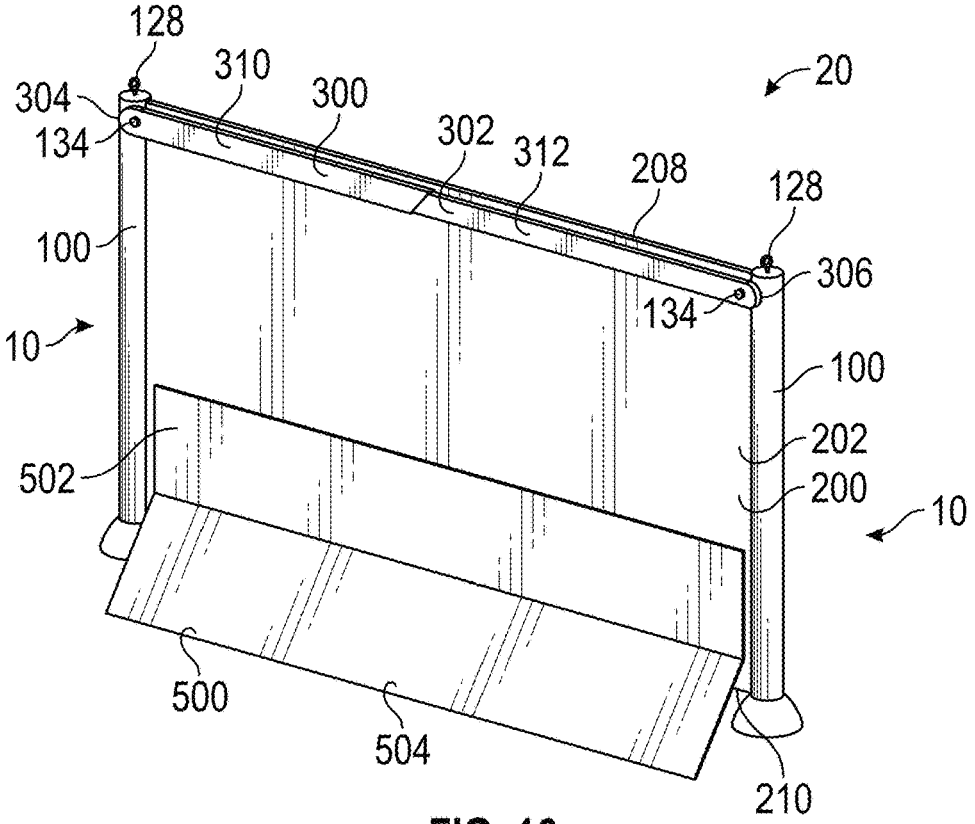
FIG. 16 is a perspective view of the wall assembly of FIG. 1 with a protective skirt.

As illustrated in FIG. 16, in some cases, the assembly 10 may optionally include a skirt 500. The skirt 500 may be removably attachable to the wall 200 or may be integrally formed with the wall 200, and is configured to cover or reduce any openings or spaces that may form between the bottom edge 210 of the wall 200 and a surface when the assembly 10 is assembled. In some cases, the skirt 500 includes a first flap 502 and a second flap 504. In this example, the first flap 502 may be removably attached to the wall 200, and the second flap 504 is pivotable relative to the first flap 502. In some cases, the second flap 504 may be at a non-zero angle relative to the first flap 502 when assembled. In various other cases, the skirt 500 may have various other configurations suitable for covering any openings below the bottom edge 210 and a surface.

Figure 17:
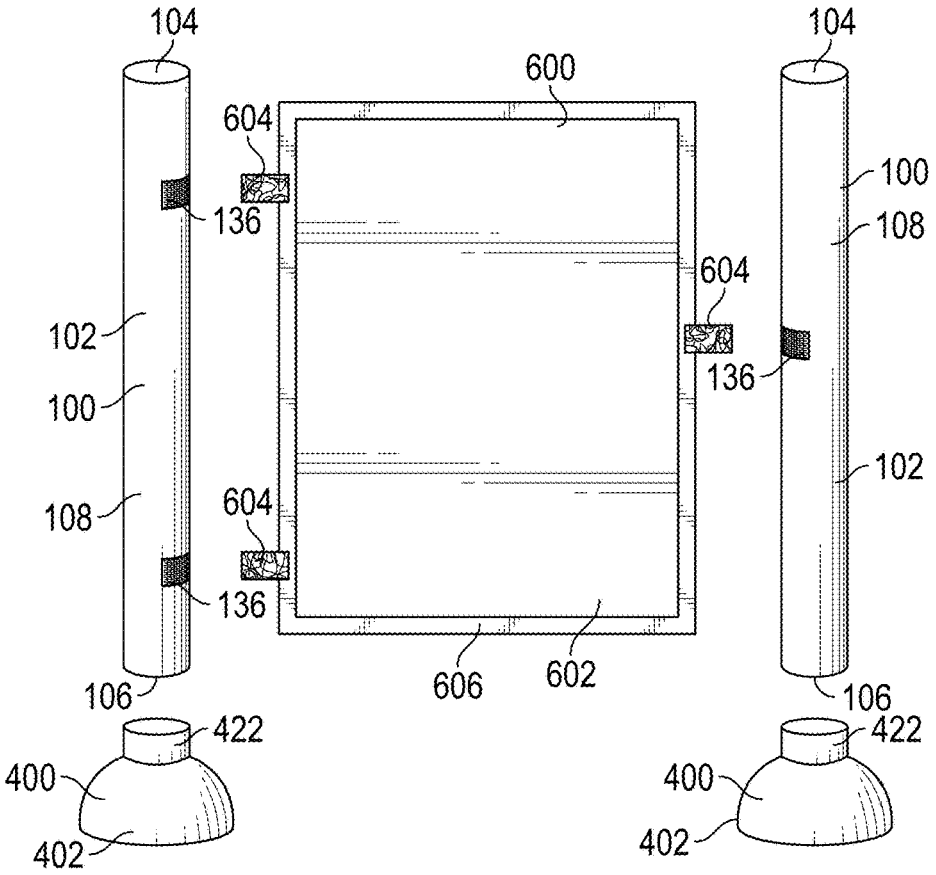
FIG. 17 is an exploded view of a door assembly according to an example of the present disclosure.
Figure 18:
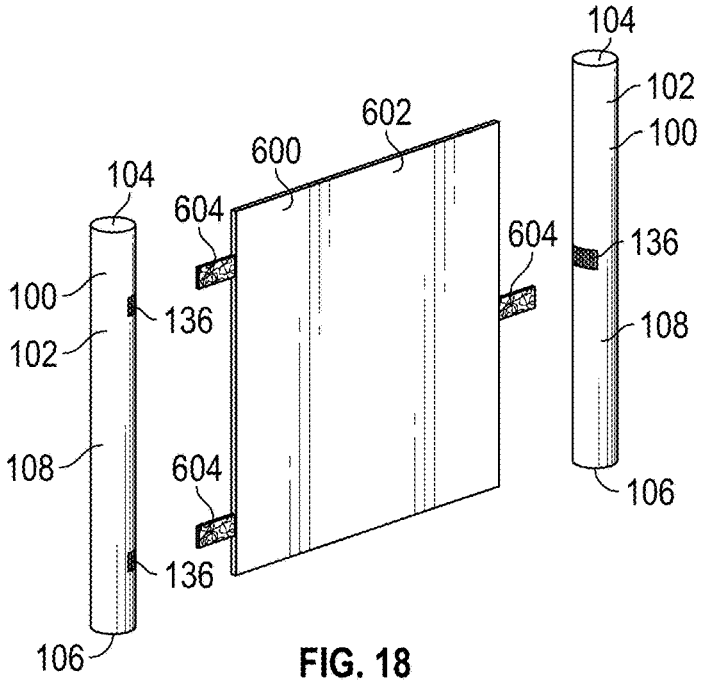
FIG. 18 is an exploded view of a door assembly according to an example of the present disclosure.

In some cases, as illustrated in FIGS. 17 and 18, the assembly 10 may include a door 600. The door 600 may be constructed from a material similar to that of the wall 200, although it need not be. The door 600 includes a body 602. In some cases, the body 602 includes reinforcements 606 (such as strips, bands, or portions of various metals, composites, impact plastics, and various other suitable reinforcing materials) around some or all of the edges of the body 602, although it need not. The door 600 includes mounting portions 604 for removably attaching the door 600 to the posts 100 and/or the walls 200. In these examples, the posts 100 may include complimentary mounting portions 136 for engagement with the mounting portions 604. In the illustrated example, the mounting portions 604 are include a plurality of hooks or loops, and the mounting portions 136 of the posts 100 are complimentary hook and loop fasteners. In various other examples, other removable mounting mechanisms such as pins, hooks, bolts, screws, clips, or various other suitable mechanisms may be utilized.

Figure 24:
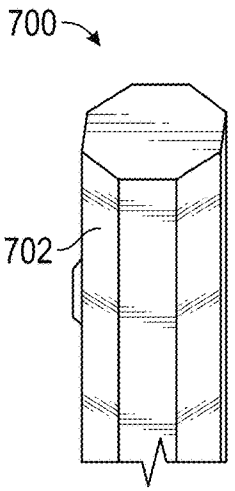
FIG. 24 is a detail view of a case for a wall assembly according to an example of the present disclosure.

In some examples, as shown in FIG. 24, a case 700 may be provided to accommodate and store the wall assembly 10 when not in use. In some examples, the case 700 includes a body 702 that defines a chamber. In some cases, the chamber is dimensioned to accommodate two wall assembly units, which includes four (?) posts 100 rotatably supporting two walls 200, four (?) bases 400, a plurality of feet 416 for the base 400, and two stabilizers 300. In various other examples, the case 700 or chamber may be dimensioned to hold additional or fewer components.

Figure 20:
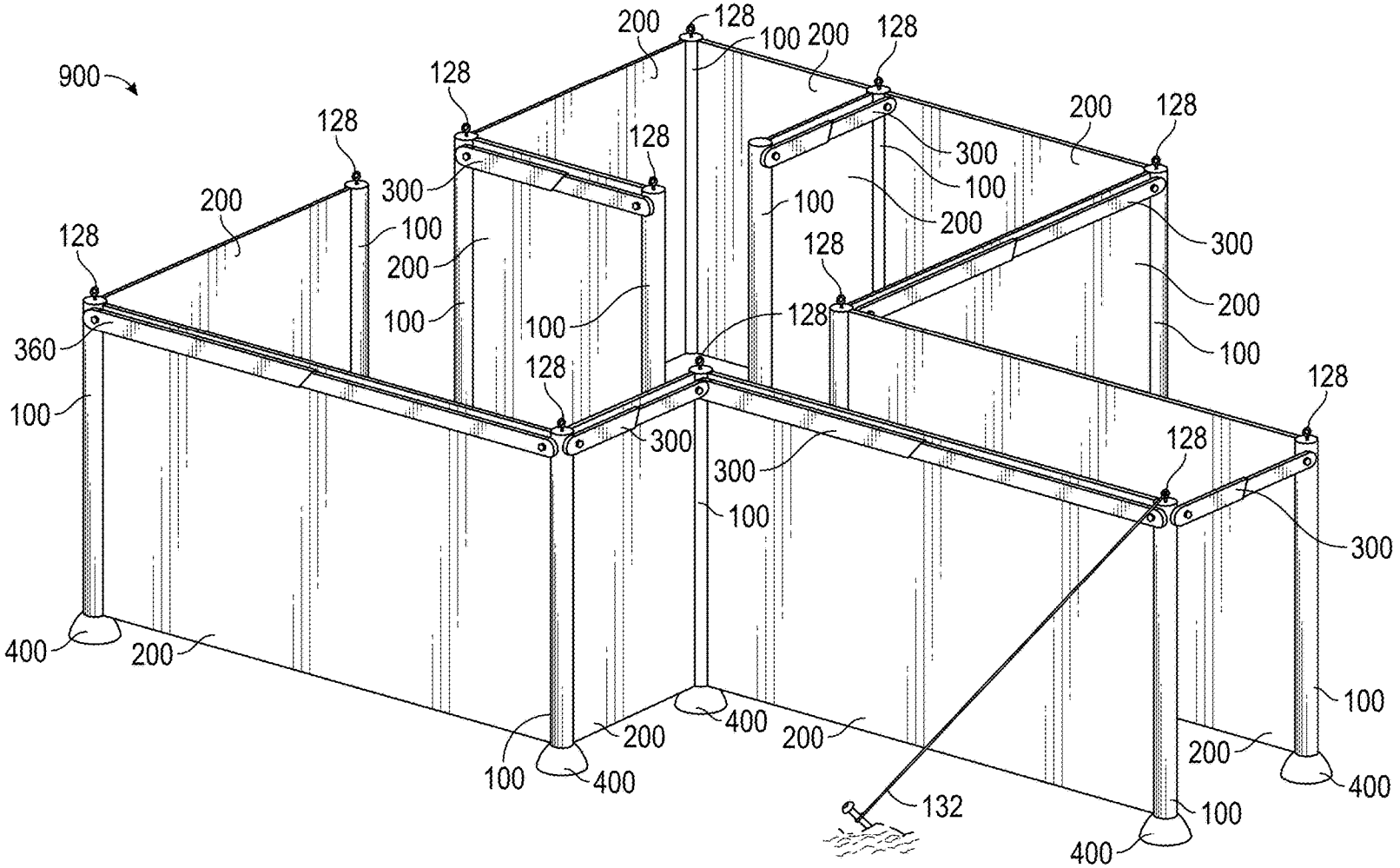
FIG. 20 is a perspective view of a wall system as assembled according to an example of the present disclosure.
Figure 21:
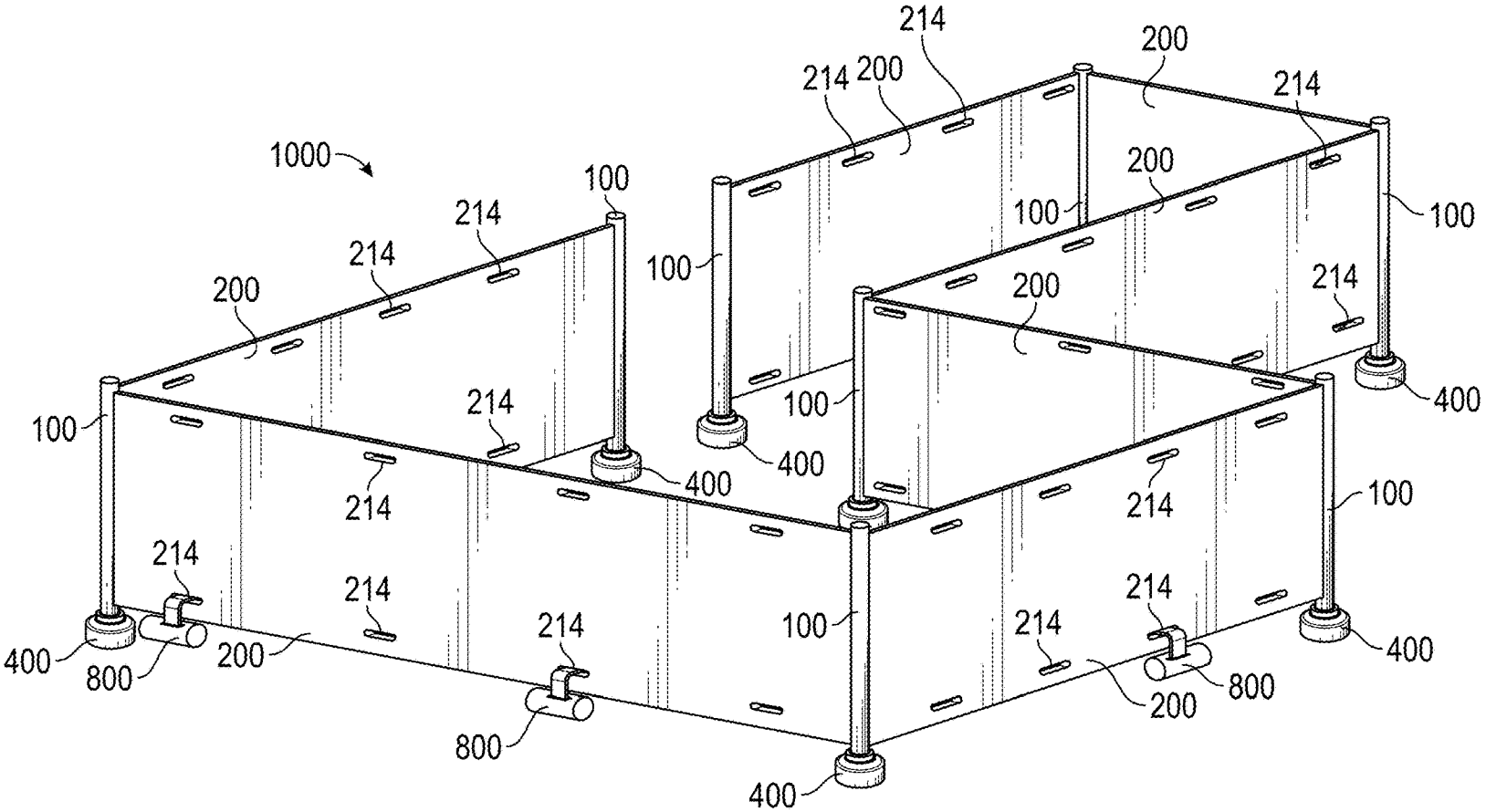
FIG. 21 is a perspective view of another wall system as assembled according to an example of the present disclosure.
Figure 22:
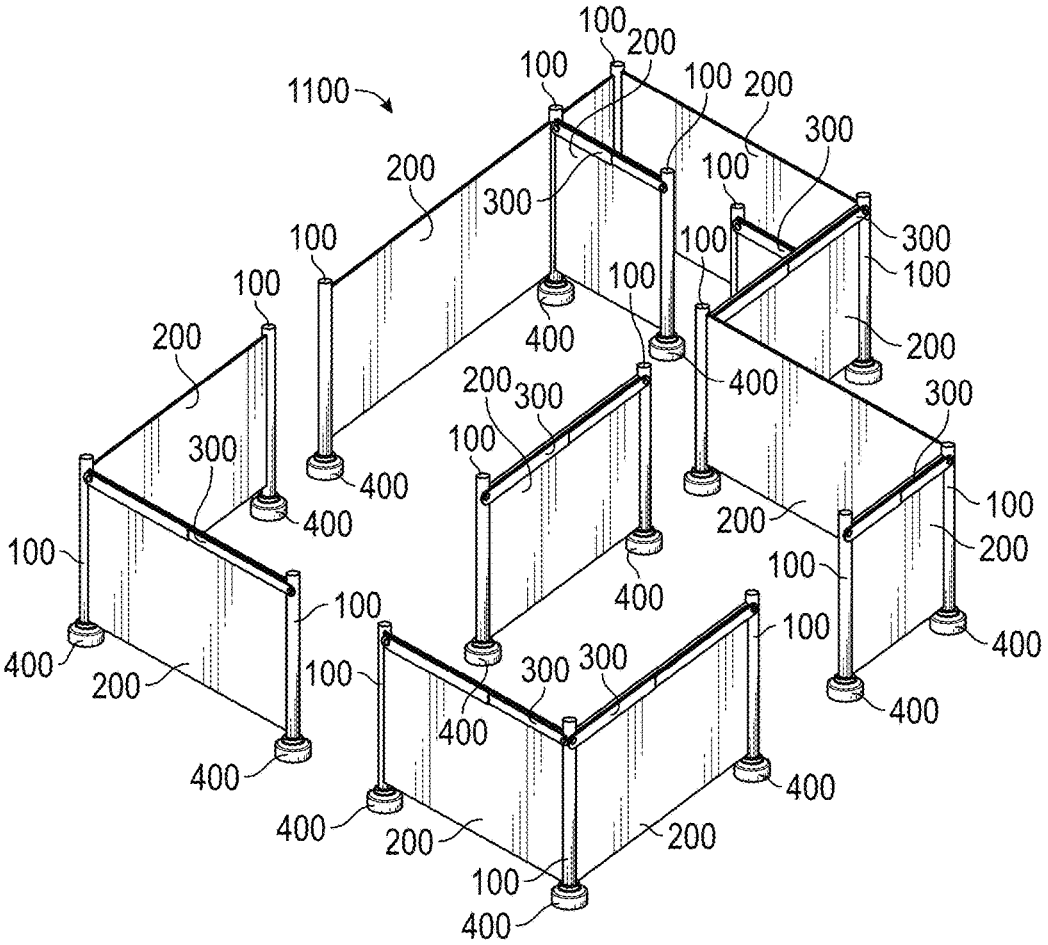
FIG. 22 is a perspective view of another wall system as assembled according to an example of the present disclosure.
Figure 23:
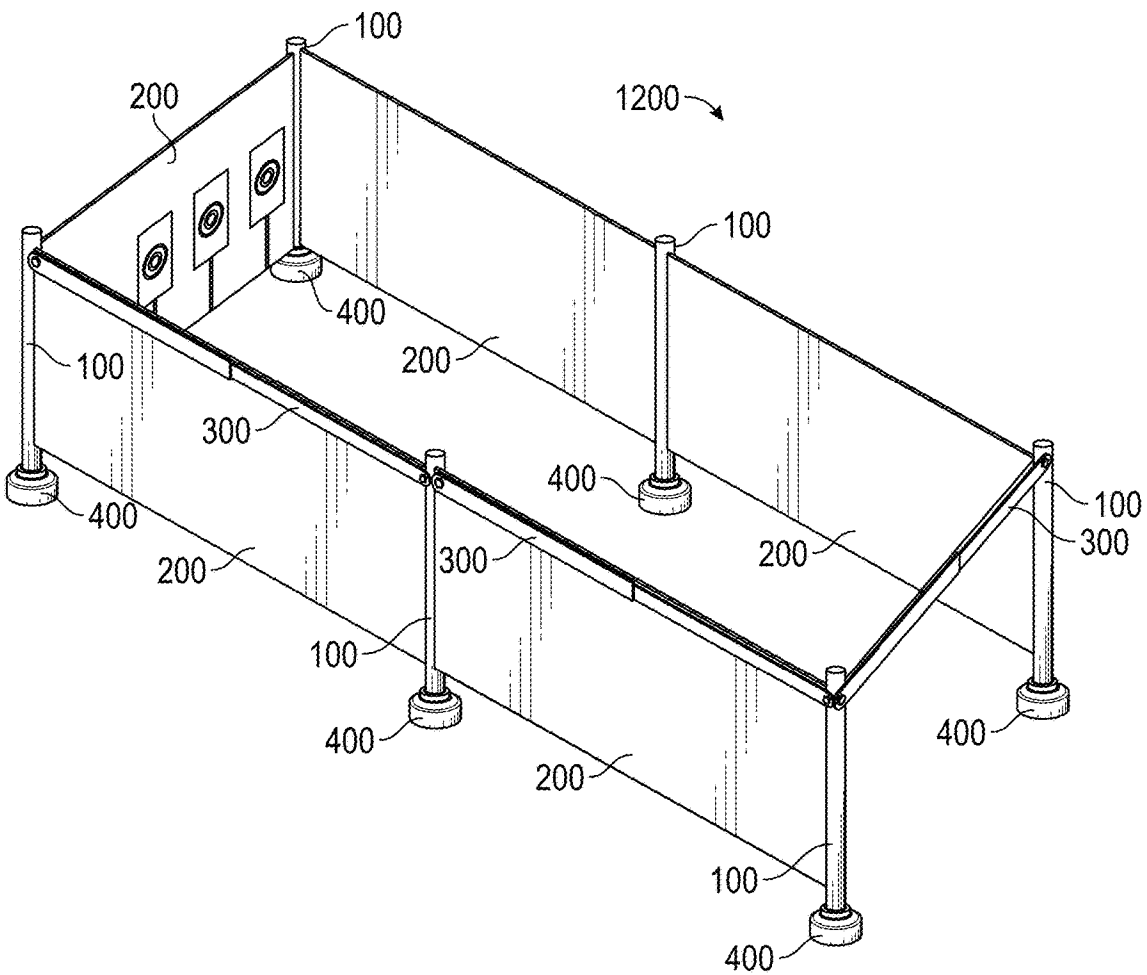
FIG. 23 is a perspective view of another wall system as assembled according to an example of the present disclosure.

FIG. 20 illustrates a non-limiting example of a wall system 900 assembled from a plurality of wall assemblies 10. In this example, the wall assemblies 10 form a multiple-spaced wall system 900. FIG. 21 illustrates another non-limiting example of another multi-spaced wall system 1000 formed from a number of wall assemblies 10. FIG. 22 illustrates another non-limiting example of a multi-spaced wall system 1100 formed from a number of wall assemblies 10. FIG. 23 illustrates an example of a shooting gallery wall system 1200 formed from a number of wall systems 10. Other wall systems having various configurations as desired may be formed using any number of wall assemblies 10.

Methods of assembling a wall system, such as the wall systems 900, 1000, 1100, or 1200 or any other wall system, are also provided. A non-limiting exemplary method includes engaging a first post (such as post 100) with a mounting portion (such as mounting portion 422) of a first base (such as base 400) such that the first post 100 is vertically supported on the first base 400. In some cases, the first base 400 may be pre-filled with a fillable material, or the first base may be filled with a fillable material during assembly. In some cases where the base includes the retainer ring 410, feet 414 may be mounted on the retainer ring 410 to expand the footprint of the base 400. In some cases, an engagement mechanism may secure the first post 100 to the first base 400. The exemplary method also includes engaging a second post (such as post 100) with a second base (such as base 400) such that the second post 100 is vertically supported on the second base 400. In various cases, the second post 100 is placed at a predetermined distance from the first post 100.

The exemplary method further includes extending a wall (such as wall 200) between adjacent posts (such as posts 100). In some cases, the first post 100 is spaced apart from the second post 100 at a distance that is equal to or less than a distance that the wall 200 spans in the fully extended configuration. Referring to FIGS. 2-4, in some cases, the wall 200 is within the first post 100 in the chamber 110 in the fully retracted configuration prior to set-up on the wall system. Because the wall 200 is rotatably supported within the chamber 110, as an installer pulls on the second end 206, the wall 200 is extended through the deployment slot 112 of the first post 100 in a controlled manner. The wall 200 is pulled and extended until the second edge 206 of the wall 200 is proximate to the second post 100. The at least one key 212 on the wall 200 is aligned with at least one keyhole 122 of at least one keyhole bracket 120 on the second post 100, and the at least one key 212 is inserted into the at least one keyhole 122. Inserting the at least one key 212 into the at least one keyhole 122 attaches the wall 200 to the second post 100 with the wall 200 spanning the distance between the first post 100 and the second post 100.

In some cases, a stabilizer (such as stabilizer 300) may be mounted on and extend between the first post 100 and the second post 100 before or after the keys 212 are engaged with the keyholes 122 to provide stability. In some cases, the method also includes securing a skirt (such as skirt 500) and/or anchors (such as anchors 800) to the wall 200. In examples where a multi-walled system is desired (see, e.g., FIGS. 20-23), the process is repeated for subsequent wall assemblies 10. For example, in the present example, a third post (such as the post 100) may be placed at a predetermined distance from the second post 100, and a wall 200 rotatably supported by the second post 100 may be extended to attach to the third post 100. Depending on the location of the at least one keyhole 122 on the second post 100 to which the at least one key 212 of the wall 200 of the first post 100 is attached, the wall 200 rotatably supported by the second post 100 may extend in a direction that is substantially parallel to the wall 200 of the first post 100, substantially perpendicular to the wall 200 of the first post 100, at an acute angle relative to the wall 200 of the first post 100, or at an obtuse angle relative to the wall 200 of the first post 100.

In various cases, if the installer decides to move the second post 100 relative to the first post 100 or take down the entire wall system, the at least one key 212 of the wall 200 that is rotatably supported by the first post 100 is removed from the at least one keyhole 122 of the at least one keyhole bracket 120 of the second post 100. The wall 200 is then retracted in a controlled manner such that a majority of the wall 200 is coiled within the chamber 110 of the first post 100 and the at least one key 212 is engaged with the deployment slot 112.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A wall system comprising:

a first wall assembly comprising:

a first post comprising a top end, a bottom end, an outer surface, and an inner surface, the inner surface defining a first chamber extending between the top end and the bottom end, the first post defining a first deployment slot extending between the top end and the bottom end and providing access to the first chamber;

a first wall comprising a first edge and a second edge, the second edge comprising at least one key, the first wall rotatably housed within the first chamber and horizontally deployable through the first deployment slot; and a second wall assembly comprising:

a second post comprising a top end, a bottom end, an outer surface, a second deployment slot extending between the top end and the bottom end, and at least one keyhole along at least a portion of the outer surface of the second post, the at least one keyhole dimensioned to accommodate one of the at least one keys and secure the one key within the at least one keyhole, wherein the second post further comprises at least one keyhole bracket supporting the at least one keyhole, wherein the second deployment slot comprises a first edge and a second edge, wherein the at least one keyhole bracket comprises a first edge and a second edge, and wherein the at least one keyhole bracket extends along the outer surface of the second post such that the first edge of the at least one keyhole bracket is proximate to the first edge of the second deployment slot and the second edge of the at least one keyhole bracket is proximate to the second edge of the second deployment slot.

2. The system of claim 1, wherein the second post further comprises an inner surface defining a second chamber extending between the top end and the bottom end, and wherein the second deployment slot provides access to the second chamber.

3. The system of claim 2, wherein the second wall assembly further comprises a second wall having a first edge and a second edge, the second wall rotatably housed within the second chamber and horizontally extendable through the second deployment slot.

4. The system of claim 1, further comprising a stabilizer extending from the first post to the second post.

5. The system of claim 4, wherein:

the first post further comprises a first mounting pin extending radially outward from the outer surface of the first post proximate to the top end of the first post;

the second post further comprises a second mounting pin extending radially outward from the outer surface of the second post proximate to the top end of the second post;

the stabilizer comprises a first end and a second end distal from the first end, wherein the stabilizer defines a first mounting bore proximate to the first end and dimensioned to accommodate the first mounting pin; and wherein the stabilizer defines a second mounting bore proximate to the second end and dimensioned to accommodate the second mounting pin.

6. The system of claim 4, wherein:

the stabilizer comprises a first end and a second end distal from the first end;

the stabilizer further comprises a first body portion and a second body portion;

the first body portion includes the first end and the second body portion includes the second end; and the first body portion is adjustable relative to the second body portion such that a distance between the first end and the second end is adjustable between a first distance and a second distance.

7. The system of claim 1, further comprising a first base vertically supporting the first post and a second base vertically supporting the second post, wherein the first base and the second base each comprise hollow bodies configured to hold a fillable material within the respective hollow bodies.

8. The system of claim 7, wherein the first base and the second base each further comprises a retainer ring and at least one foot, wherein the at least one foot comprises a body and a foot key, wherein the retainer ring defines at least one foot slot dimensioned to accommodate the foot key of the at least one foot.

9. The system of claim 1, wherein:

the first wall is horizontally deployable through the first deployment slot between a fully retracted configuration and a fully extended configuration;

in the fully retracted configuration, a majority of the first wall is housed within the first chamber and the at least one key is engaged with the first deployment slot; and in the fully extended configuration, the majority of the first wall is exterior to the first chamber and the at least one key of the wall is received within the at least one keyhole of the second post.

10. The system of claim 1, wherein the second edge of the first wall further comprises a reinforcing member.

11. The system of claim 1, wherein the second post comprises a plurality of keyhole brackets along the outer surface of the second post between the top end and the bottom end of the second post, and wherein each one of the plurality of keyhole brackets comprises a plurality of keyholes.

12. The system of claim 1, wherein the first wall comprises a window.

13. A method of assembling a wall system comprising:

mounting and vertically supporting a first post on a first base;

mounting and vertically supporting a second post on a second base;

horizontally deploying a first wall through a first deployment slot defined in the first post, the first wall rotatably housed within a chamber defined by the first post, the first deployment slot extending between a top end of the first post and a bottom end of the first post; and detachably engaging at least one key on an edge of the first wall with at least one keyhole provided on an outer surface of the second post, wherein the second post further comprises a second deployment slot and at least one keyhole bracket supporting the at least one keyhole, wherein the second deployment slot comprises a first edge and a second edge, wherein the at least one keyhole bracket comprises a first edge and a second edge, and wherein the at least one keyhole bracket extends along the outer surface of the second post such that the first edge of the at least one keyhole bracket is proximate to the first edge of the second deployment slot and the second edge of the at least one keyhole bracket is proximate to the second edge of the second deployment slot.

14. The method of claim 13, further comprising mounting a stabilizer between the first post and the second post; wherein mounting the stabilizer comprises mounting a first end of the stabilizer on a first mounting pin on the first post and mounting a second end of the stabilizer on a second mounting pin on the second post.

15. The method of claim 14, further comprising moving a first body portion of the stabilizer relative to a second body portion of the stabilizer to move the first end of the stabilizer from a first distance to a second distance relative to the second end of the stabilizer, wherein the first body portion comprises the first end of the stabilizer and the second body portion comprises the second end of the stabilizer.

16. The method of claim 13, further comprising disengaging the at least one key from the at least one keyhole and retracting the first wall through the first deployment slot into the chamber, wherein retracting the first wall further comprises engaging the at least one key with the first deployment slot exterior to the chamber.

17. The method of claim 13, further comprising removably attaching a foot to a retainer ring of the first base.

18. The method of claim 13, further comprising:

mounting and vertically supporting a third post on a third base;

horizontally deploying a second wall through the second deployment slot defined in the second post, the second wall rotatably housed within a chamber defined by the second post, the second deployment slot extending between a top end of the second post and a bottom end of the second post; and detachably engaging at least one key on an edge of the second wall with at least one keyhole provided on an outer surface of the third post.

19. The method of claim 18, wherein horizontally deploying the second wall comprises extending the second wall at a non-zero angle relative to the first wall.

* * * * *